United States Patent [19]

Thiessens et al.

[11] 3,947,955

[45] Apr. 6, 1976

[54] METHOD OF MAKING AN INDUCTIVE STABILIZING BALLAST FOR A GAS AND/OR VAPOUR DISCHARGE LAMP

[75] Inventors: Alexander Joseph Gerardus Thiessens; Leonard Woldring, both of Eindhoven, Netherlands

[73] Assignee: U.S. Philips Corporation, New York, N.Y.

[22] Filed: Jan. 21, 1975

[21] Appl. No.: 542,838

[30] Foreign Application Priority Data

Feb. 9, 1974 Netherlands ..... 741806

[52] U.S. Cl. ..... 29/606; 29/609; 336/61; 336/83; 336/234

[51] Int. Cl.[2] ..... H01F 41/02

[58] Field of Search ..... 29/606, 602, 609; 336/61, 336/83, 155, 160, 165, 221, 234

[56] References Cited

UNITED STATES PATENTS

| | | | |
|---|---|---|---|
| 2,584,564 | 2/1952 | Ellis | 29/609 X |
| 2,764,802 | 10/1956 | Feiertag | 29/606 |
| 3,080,641 | 3/1963 | Marley | 29/606 X |
| 3,309,641 | 3/1967 | Burkhardt et al. | 29/609 X |
| 3,500,273 | 3/1970 | Hoell | 336/61 |

*Primary Examiner*—Carl E. Hall

*Attorney, Agent, or Firm*—Frank R. Trifari; Bernard Franzblau

[57] ABSTRACT

The invention relates to a method of manufacturing an inductive stabilizing ballast for a gas and/or vapour discharge lamp.

According to the invention, after placing the laminations in and about the coil, part of each lamination is turned about an axis which is parallel to the centre line of the electric coil so that the lamination parts are tightly turned against the electric coil. This leads to a satisfactory thermal contact between the coil and the casing so that the removal of heat from the coil is enhanced.

6 Claims, 8 Drawing Figures

METHOD OF MAKING AN INDUCTIVE STABILIZING BALLAST FOR A GAS AND/OR VAPOUR DISCHARGE LAMP

The invention relates to a method of manufacturing an inductive stabilizing ballast for a gas and/or vapour discharge lamp. The ballast is of the casing type and is composed of an electric coil and at least one pack of mutually substantially equal laminations engaging one another over the largest part of their surface. At least part of each lamination is turned about an axis after placing said laminations about the electric coil. The invention also relates to an inductive stabilizing ballast manufactured by means of this method.

A known method of the kind mentioned above is described, for example, in German Utility Model No. 1849769. In this known method the lamination parts are turned so as to adjust the size of the air gap of the inductive stabilizing ballast. A drawback of a stabilizing ballast manufactured by this known method is the poor quality of the mechanical contact between the lamination pack and the outer side of the electric coil. This means that the heat from the coil in this known inductive stabilizing ballast can be rather poorly conducted away.

An object of the invention is to provide a method of the above-mentioned kind so as to realize an inductive stabilizing ballast in which the heat from the electrical coil can be conducted away satisfactorily.

According to the invention a method of manufacturing an inductive stabilizing ballast for a gas and/or vapour discharge lamp, which ballast is built up of an electric coil and at least one pack of mutually substantially equal laminations engaging one another over the largest part of their surface, in which the ballast is of the casing type and in which at least part of each lamination is turned about an axis after placing said laminations about the electric coil, is characterized in that said axis is parallel to the centre line of the electric coil and the lamination parts are turned so far that the casing is tightly clamped about the electric coil.

An advantage of this method is that due to the tight clamping of the lamination casing about the electric coil a satisfactory mechanical contact between these parts is obtained so that the removal of heat from the electric coil is enhanced to a great extent.

A further advantage of the method according to the invention is that an inductive stabilizing ballast is obtained having a more slender profile than in the case where the packs are not turned. A slender profile is understood to mean that the rectangular cross-section of the ballast has small dimensions. It is possible to discontinue turning of the lamination parts when the lamination parts are clamped against the coil.

Furthermore it is feasible that the lamination parts are then slightly turned further so that the windings of the electric coil are more closely pressed together. This leads to an even better thermal contact enhancing the cooling of the ballast.

In a preferred embodiment according to the invention the lamination parts, after having been turned so far that the casing tightly clamps about the electric coil, are still further turned about the said axis so that the cross-section of the electric coil undergoes a deformation. The cross-section of the electric coil is understood to mean a cross-section of the coil located in the plane of a winding thereof. This cross-section is, for example, initially rectangular and after its deformation it has, for example, the shape of a parallelogram.

An advantage of this preferred method is that it leads to a still more slender profile of the ballast. This may be useful when designing luminaires for discharge lamps stabilized with these ballasts.

To reduce the air gap of the ballast a second pack of laminations may be used.

In a preferred embodiment according to the invention in which a second pack of mutually substantially equal laminations also is placed about the electric coil, the lamination parts of the second pack are turned about the same axis (axes) simultaneously when the lamination parts of the first pack are turned.

An advantage of this preferred method is that a ballast having both a satisfactory cooling and a small air gap can be obtained in a simple manner.

It is feasible that for each lamination of a pack there applies that the entire lamination is turned over an angle. This is not accompanied by deformation of a lamination. It is, however, alternatively feasible that only part of each lamination is turned. It is also possible for one lamination part to be turned more than another.

In a further preferred embodiment according to the invention in which the turning part of each lamination of a pack of the casing is an end part of this lamination and in which the cross-section of the electric coil is substantially not deformed, a further end part of each lamination of this pack of the casing is turned about a different axis which is also parallel to the centre line of the electric coil, while the central part of each lamination is not turned.

An advantage of this preferred method is that possible lamination parts located within the coil may maintain a reasonable thermal contact with this coil.

In an inductive stabilizing ballast according to the invention each lamination of a pack will generally constitute an angle of 85° at a maximum with the stacking direction of the laminations of this pack. The stacking direction is to be understood to mean the direction indicated by the line on which the central points of these laminations are located. This means that the relevant lamination parts are generally turned over at least 5°. Still smaller turning angles would mean that the clearance between pack and coil is so small that placing the pack about the coil would be complicated.

An inductive stabilizing impedance which is manufactured by means of a method according to the invention may be built up of, for example, a combination of U and I laminations.

Preferably, the laminations are present as a combination of a pack of E laminations and a pack of T laminations.

The invention will be described in greater detail with reference to the accompanying drawing in which:

FIG. 1 shows a combination of a pack of E laminations, an electric coil and a pack of T laminations. This combination serves for carrying out a method according to the invention. The three parts are shown in a perspective view.

FIG. 4 is a perspective view of the inductive stabilizing ballast according to the invention of which FIG. 3 is a plan view.

Figure 1:
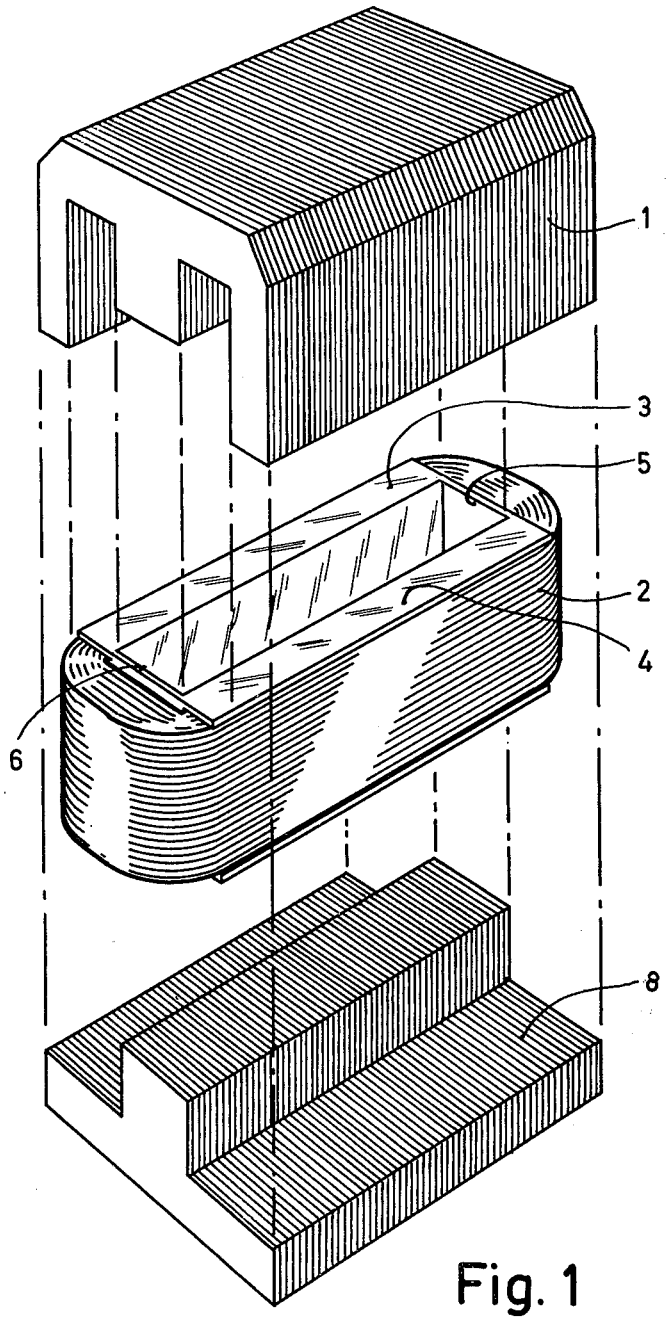

In FIG. 1 the reference numeral 1 denotes a pack of E laminations. An electric coil 2 having a substantially rectangular cross-section is arranged below this pack. The reference numerals 3 and 4 denote two substantially undeformable U-shaped insulating wall sections which are connected by connection parts 5 and 6. These prevent the sides of the coil from being deformed during manufacture. The parts 5 and 6 may move relative to the parts 3 and 4. The reference numeral 8 denotes a pack of T laminations.

The method carried out is that with a suitable tool (not shown) the E laminations are placed about the coil with their side legs straddling the coil 2 and with their central legs inside the coil. Subsequently the lamination pack 8 is moved into the lower side of the coil. This means that the long legs of the E laminations 1 will engage the T laminations 8 and that an air gap is formed between the short legs of the pack 1 and the pack 8. This air gap is then present within the coil 2.

Figure 2:
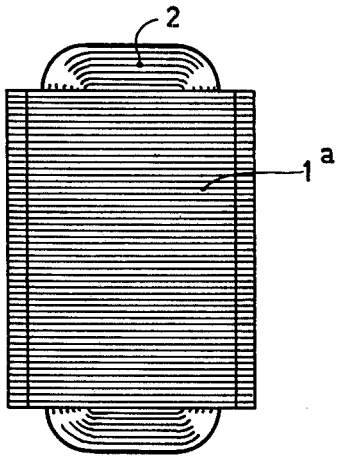
FIG. 2 is a plan view of the part of FIG. 1 after assembly.

In FIG. 2 the reference numeral 1*a* denotes the upper side of the E lamination pack 1 and reference numeral 2 is the electric coil.

Figure 3:
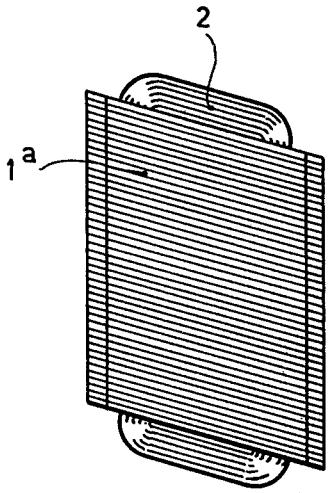
FIG. 3 shows an inductive stabilizing ballast according to the invention in a plan view similar to that of FIG. 2, but in a final stage of manufacture.

Subsequently the E and T laminations are turned about the centre line of the coil 2 over an angle of approximately 15°. This leads to the situation shown in FIG. 3. The centre line of coil 2 is at right angles to the plane of the drawing in FIGS. 2 and 3. It can be seen that during turning the coil 2 also is deformed so that the original substantially rectangular cross-section assumes the shape of a parallelogram. The E and T laminations are then secured together, for example, by means of welding or clamping.

Figure 4:
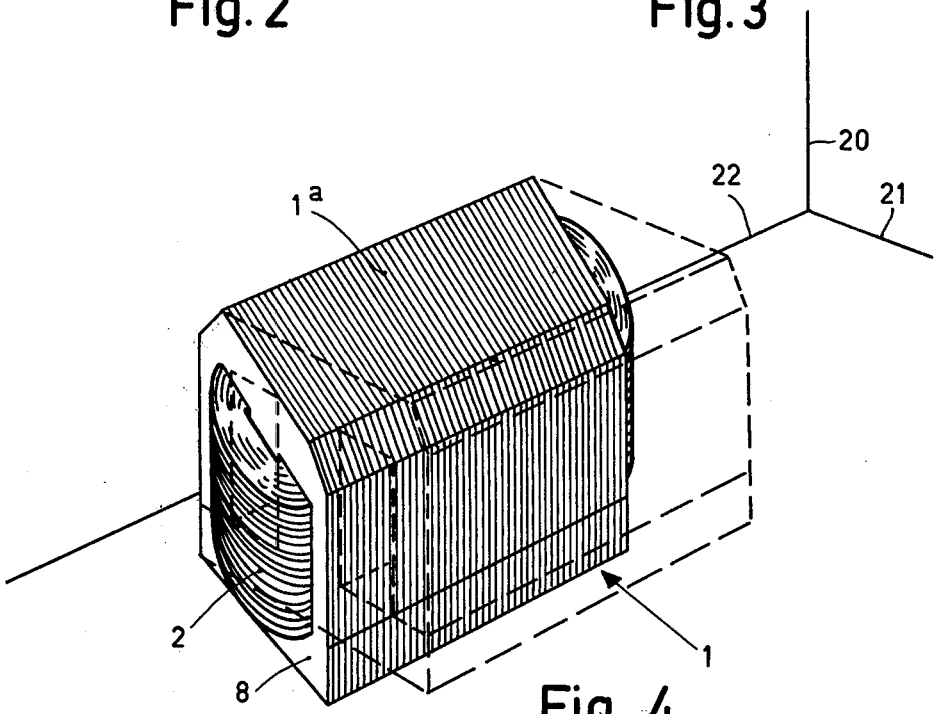

In FIG. 4 all this has been shown in a perspective view where the solid lines show the ultimately obtained inductive stabilizing ballast and the broken lines show the situation before turning of the lamination packs 1 and 8. For the sake of clarification FIG. 4 also shows a cross of axes with three mutually right-angled axes which are denoted by reference numerals 20, 21 and 22, respectively. The dimensions of the ballast thus obtained were approximately 7 × 4 × 3.5 cm.

Figure 5:
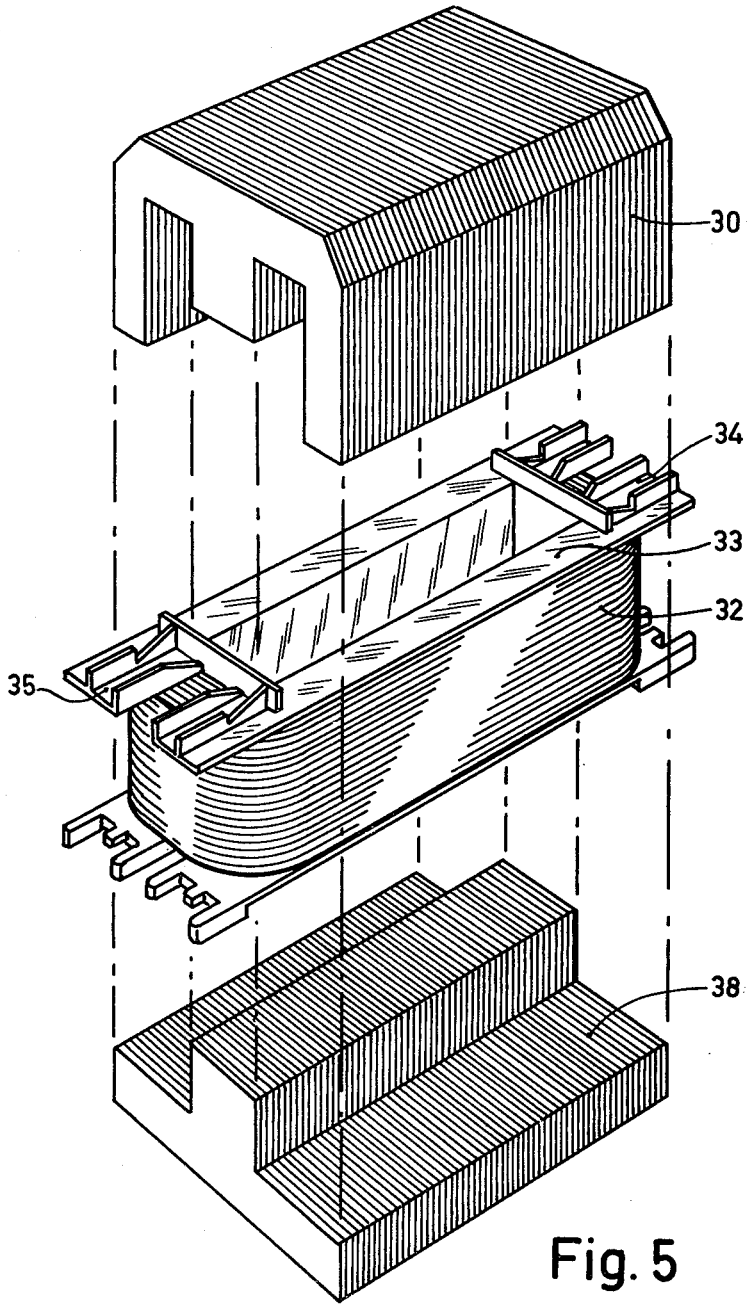
FIG. 5 is a perspective view similar to that of FIG. 1 in which, however, the central part, an electric coil is provided with a coil former that is substantially undeformable.

Similar to the device shown in FIG. 1 a pack of E laminations 30 and a pack of T laminations 38 is shown in FIG. 5. An electric coil 32 in this case envelopes a substantially undeformable coil former 33. Reference numerals 34 and 35 denote connection contacts on the coil former 33.

Figure 6:
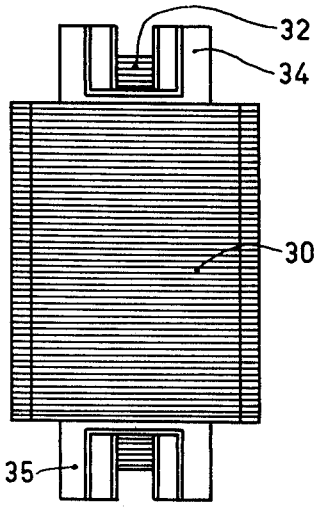
FIG. 6 is a plan view of the combination of the parts of FIG. 5 after assembly.

FIG. 6 is a plan view of the parts of FIG. 5, namely after assembly of the lamination packs 30 and 38 about the electric coil 32.

Figure 7:
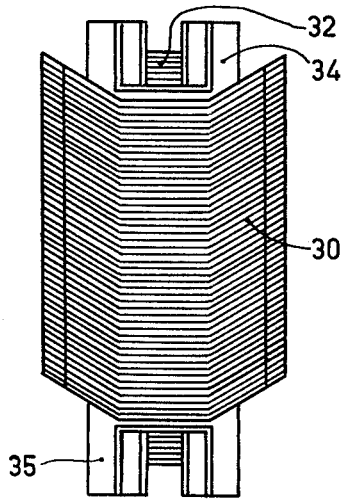
FIG. 7 shows a second inductive stabilizing ballast according to the invention in a plan view similar to that of FIG. 6 but in a final stage of manufacture.

FIG. 7 shows the final stage of manufacture in which one half of end parts of each E-T lamination combination is turned about a first group of axes and the other half of end parts of each E-T lamination combination is turned about a second group of axes so that each lamination is bent twice. The turning angles were approximately 30°. The first and second group of axes are parallel to the centre line of the coil 30. In this method the coil former is not deformed. It is achieved that the interior of the E and T casing tightly engages the outer side of the electric coil 32. After turning of the lamination parts the E laminations are again secured to the T laminations. The finished product is shown in a perspective view in FIG. 8. The dimensions of this product are approximately the same as those of the ballast of FIG. 4.

The described stabilizing ballasts are intended to be connected to an alternating voltage source in series with a gas and/or vapour discharge lamp. Each of the ballasts will then serve for stabilizing the electric current through a lamp of the said type.

Figure 8:
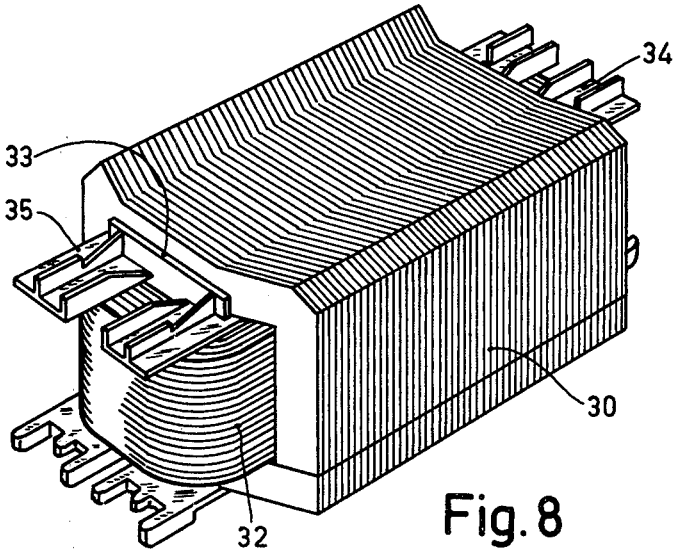
FIG. 8 is a perspective view of the second inductive stabilizing ballast according to the invention.

As regards cooling of the coil 32 of FIG. 8 of this inductive stabilizing ballast according to the invention relative to cooling of the same coil of an inductive stabilizing ballast not according to the invention, i.e. without turned laminations, the following can be noted: It was found that at a current intensity of approximately 0.5 ampere through the electric coil the temperature gradient between the electric coil and the outer side of the lamination casing in the case of FIG. 8 (i.e. for a ballast according to the invention) was approximately 15% lower than in a similar ballast in which the laminations were not turned. This means, for example, that the ballast according to the invention can be loaded with a slightly higher electric current. This also means that this ballast may be used in combination with a lamp proportioned for a slightly higher current intensity.

What is claimed is:

1. A method of manufacturing an inductive stabilizing ballast for an electric discharge lamp, said ballast comprising an electric coil and at least one pack of substantially identical laminations engaging one another over the largest part of their surface, the ballast being of the casing type, the method comprising, placing a stack of said laminations about the electric coil, and turning at least part of each lamination about an axis that is parallel to the centre line of the electric coil until the lamination parts are tightly clamped about the electric coil to provide substantial surface contact therebetween to enhance the removal of heat from the coil.

2. A method as claimed in claim 1, wherein the lamination parts, after having been turned so far that the casing tightly clamps about the electric coil, are still further turned about the said axis so that the cross-section of the electric coil undergoes a deformation.

3. A method as claimed in claim 1, comprising the further step of placing a second pack of substantially identical laminations about the electric coil prior to said turning step and then turning the lamination parts of the second pack about the same axis simultaneously with the turning of the lamination parts of the first pack.

4. A method as claimed in claim 1 wherein said turning step comprises turning an end part of each lamination of the casing so that the cross-section of the electric coil is substantially not deformed, and turning a further end part of each lamination of the casing about a different axis which is also parallel to the centre line of the electric coil, while the central part of each lamination is not turned.

5. A method of manufacturing an inductive ballast for an electric discharge lamp, the method comprising forming a first stack of identical E-shaped laminations, forming a second stack of identical T-shaped laminations, placing said first and second stacks of laminations together about an electric coil so that the center parts of the E and T shaped laminations are juxtaposed within the coil window to form an air gap therebetween and the outer parts of said laminations substantially surround the coil, and turning a part of each lamination about an axis that is parallel to the center line of the electric coil and through an angle such that the lamination parts are in good thermal contact with the electric coil over a substantial part of the coil surface.

6. A method as claimed in claim 5 wherein said turning angle is approximately 15°, said method comprising the further step of securing the E-shaped laminations to the T-shaped laminations subsequent to the turning step.

* * * * *

UNITED STATES PATENT AND TRADEMARK OFFICE

CERTIFICATE OF CORRECTION

PATENT NO. : 3,947,955

DATED : April 6, 1976

INVENTOR(S) : ALEXANDER J. G. THIESSENS ET AL

It is certified that error appears in the above-identified patent and that said Letters Patent are hereby corrected as shown below:

ON THE TITLE PAGE

Below "Foreign Application Priority Data" cancel "741806" and insert -- 7401806 --;

Signed and Sealed this

Fourteenth Day of September 1976

[SEAL]

*Attest:*

RUTH C. MASON
*Attesting Officer*

C. MARSHALL DANN
*Commissioner of Patents and Trademarks*